US005096510A

United States Patent [19]

Schoen et al.

[11] Patent Number: 5,096,510

[45] Date of Patent: Mar. 17, 1992

[54] THERMAL FLATTENING SEMI-PROCESSED ELECTRICAL STEEL

[75] Inventors: Jerry W. Schoen, Middletown; Dannie S. Loudermilk, Cincinnati, both of Ohio

[73] Assignee: Armco Inc., Middletown, Ohio

[21] Appl. No.: 448,397

[22] Filed: Dec. 11, 1989

[51] Int. Cl.[5] ..... H01F 1/04

[52] U.S. Cl. ..... 148/111; 148/113

[58] Field of Search ..... 148/111, 112, 113; 29/605, 609

[56] References Cited

U.S. PATENT DOCUMENTS

| | | | |
|---|---|---|---|
| 2,104,169 | 6/1938 | Schorschu | 148/12 |
| 2,282,163 | 11/1942 | Burgwin | 148/4 |
| 2,351,922 | 6/1944 | Burgwin | 148/21.5 |
| 2,412,041 | 9/1946 | Gifford et al. | 148/12 |
| 2,980,561 | 4/1961 | Ford et al. | 148/111 |
| 3,130,088 | 5/1964 | Cook | 148/12 |
| 3,161,225 | 4/1964 | Ward et al. | 153/86 |
| 3,421,925 | 1/1969 | Hair et al. | 148/112 |

*Primary Examiner*—John P. Sheehan

*Attorney, Agent, or Firm*—Larry A. Fillnow; Robert J. Bunyard; Robert H. Johnson

[57] ABSTRACT

The thermal flattening of grain oriented silicon steel which is in the semi-processed condition has improved magnetic properties after a stress relief anneal by using a low temperature and high tension flattening anneal. The flattening process is conducted at a temperature between 1000° to 1435° F. (540° to 780° C.) with a tension selected to produce a yield strength/tension ratio from above 5 to about 20 and preferably from 7 to 13. The yield strength of the material will vary depending on the length of the time at peak temperature but are typically from 400 to 4000 psi (29,200 to 292,000 gm/cm$^2$). The material as thermally flattened will have at least about 10% stress. After a stress relief anneal above about 1450° F. (785° C.), the material has significantly improved core loss compared to conventional thermally flattened material. The material is particularly suited for wound transformer core applications.

16 Claims, 7 Drawing Sheets

THERMAL FLATTENING SEMI-PROCESSED ELECTRICAL STEEL

BACKGROUND OF THE INVENTION

Thermal flattening silicon steel strip has required many more considerations than just flatness. In the past, electrical steel has had to consider the influences of the thermal flattening on annealing separators, secondary coatings and magnetic properties. Thermal flattening has also been combined with stress relief annealing as part of the same process. Silicon steel strip which is produced in the flattened condition but requires additional heat treatment is identified as semi-processed and the customer typically provides a stress relief anneal after the electrical steel sheet is fabricated into laminations which are then assembled into the electromagnetic equipment.

In the manufacture of wound core transformers, the electrical steel is subjected to severe mechanical stresses during fabrication of the core which ultimately must possess excellent magnetic properties. The magnetic properties are developed after a stress relief anneal at temperatures of at least about 1450° to 1500° F. (785° to 815° C.). Grain oriented electrical steels are particularly suited for use in transformers with wound cores. This equipment requires excellent flatness in the strip.

Strains are developed in silicon steel production from numerous operations and conditions. If the strains are not removed, there is an increase in hysteresis loss when the steel is used in electrical equipment and this impairs its magnetic properties. The strains from slitting, winding and fabricating during core production must also be removed to achieve the desired magnetic properties.

Oriented electrical steel is thermally flattened to produce strip for transformers or generator laminations. Flattening the strip involves the use of tension to remove irregularities such as deformed edges, wavy edges, and buckles. However, the use of tension and the resultant elongation introduces stress which needs to be minimized. Temperatures of about 815° C. (1500° F.) are frequently used during flattening to remove the stresses caused by flattening and prior processing.

The tension limitations for electrical steel at elevated temperatures have been the subject of many investigations. U.S. Pat. No. 2,351,922 describes the strip tension of 500 to 2000 pounds per square inch which is below the elastic limit of the alloy. The temperatures during tension were from 700° C. to 825° C. for periods of about 1 to 2 minutes.

U.S. Pat. No. 2,412,041 taught the tensile strength of the electrical steel varies with the temperature and that a tension sufficient to prevent sagging between the support rolls will produce excellent flatness in the strip. This tension is provided by operating the exit rolls at a peripheral speed of 0.1 to 0.5% faster than the entrance rolls. The amount of tension required will vary with the composition and the gage of the material, the temperature and the length of time. The patent states a permanent elongation of 0.15 to 0.3% is normal. Temperatures as low as 1200° F. are mentioned but flatness control was only required to be below the graphite solubility temperature. If the carbon content is low, much higher temperatures may be used and the limit is determined by the mechanical factors. An electrical steel with less than 4% silicon which has been decarburized may be annealed at around 1500° to 2100° F. under tension to produce the desired magnetic properties and flatness. If the material is brought to the softening temperature under tension, there is not much of a restriction on holding time. The strip will reach the desired temperature within about 1 minute, depending on gage, and is preferably cooled slowly. Atmosphere forms no limitation on the invention since it does not affect flatness. The atmosphere is selected in accordance with its effect on core loss, ductility or brightness.

U.S. Pat. No. 3,130,088 describes the influence of roll diameter during flattening and the spacing between the rolls. Part of the furnace relies on a series of rolls which alternately pass the strip over and under the rolls to increase the flatness. The best results were obtained by using a preferred temperature of 1450° F. to 1500° F. with 1100 to 2200 psi strip tension. The patent admits it is impossible to describe the combination of stresses which produce the flattening at elevated temperatures. The phenomenon of creep and structural instability of metals at elevated temperatures made the process too complex because of the interplay of the many variables.

U.S. Pat. No. 3,161,225 attempted to flatten the electrical steel strip without introducing any stress to provide the optimum magnetic properties. A controlled reverse curvature of the strip was found to remove coil set during flattening and minimize the stress caused by tension and flexing of the strip. It was taught that a plastic strain as small as 0.05% elongation caused by bending or tension resulted in irrecoverable damage to the magnetic properties. Tension is limited to be no greater than that required to advance the strip. Particularly this level should be below 1000 psi and preferably about 100 psi.

Prior thermal flattening processes for electrical steel have thus known there is a wide range of conditions which produce a flat strip. However, the flattening process has typically been one which minimizes stress and thus uses low tension for low stress or uses high temperature for flattening which is part of a stress relief anneal. The prior work done with various thermal flattening processes have ignored the influence of the conditions on the coatings. The coatings were expected to survive or be modified to not require any special considerations.

The prior practices for thermal flattening grain oriented silicon steel have varied considerably. Tension has varied from 100 psi up to the elastic limit of the steel. Temperatures from 900° F. to 2100° F. have been investigated. Various roll configurations and diameters have been studied. However, the prior studies have not taken into consideration the influence of the flattening conditions on the responsiveness of the material to a stress relief anneal. Prior processes have been mainly directed to the fully processed material and have not found the conditions for flattening which are most responsive to stress relief annealing by the customer after the electrical steel products are fabricated.

Prior practices have not investigated what the temperatures and tensions were doing to the surface coatings. The combination of thermal flattening and stress relief annealing for semi-processed silicon steel is basically a rather new product for oriented silicon steel.

Thinner gages of electrical steel have considerably more problems in wound core applications than prior material of heavier gages but the improved magnetic properties justify their use. With thinner material, there is more difficulty in gage control, there is less stiffness in the material, there is more difficulty in obtaining the desired flatness and there is more of a winding or handling problem because of coil set and shape problems.

It is a principle object of the present invention to develop a practice for thermal flattening silicon steel which optimizes the magnetic quality of the steel for wound core applications and other semi-processed applications which require stress relief annealed after fabrication. A further principle object of the present invention is to improve the tension imparting characteristics of a secondary coating by modifying the conditions of the thermal flattening process.

Another object of the present invention is the development of a process which uses moderately low temperatures and higher tension to provide thermal flattening for wound transformer core applications. This has considerable advantages over other practices where extremely low levels of tension are used in this processing step. The present invention allows high tension levels which improve strip tracking in the furnace. The present invention also increases the yield strength of the base metal during thermal flattening to allow the use of high tension without damage to the base metal at the elevated temperatures. The present invention also permits the use of furnaces for thermal flattening which previously could not be used because of tension limitations.

A further object of the present invention is to provide a semi-processed silicon steel strip which after the thermal flattening process of the invention will provide improved handling characteristics during winding of the core and improved magnetic properties after the stress relief anneal.

The thermal flattening process of the present invention provides other advantages which will become apparent to those skilled in the art from the description which follows.

SUMMARY OF THE INVENTION

The present invention has improved the quality of grain oriented electrical steel by adjusting the tension and temperature conditions during thermal flattening. The electrical steel may be flattened over a critical range of conditions if the proper relationships are maintained. The magnetic properties after stress relief annealing are improved if the thermal flattening operation is conducted at a lower temperature and with higher tensions to produce the same quality of flattening but without the complete removal of stress.

A thermal flattening process in the range of 1000° to 1435° F. (540° to 780° C.) is used in the present practice with a tension adjusted to provide a 0.2% yield strength/tension ratio from above 5 to about 20 and preferably about 7 to 13. Tension levels from about 400 to 4000 psi (29,200 to 292,000 gms/cm$^2$) have been used to produce a finer deformation substructure in the base metal which is more amenable to stress relaxation in the stress relief anneal. Preferably a temperature of about 1175° F. to 1375° F. (635° C. to 745° C.) is used in combination with a tension of about 500 to about 2500 psi (36,500 to 182,500 gms/cm$^2$). The yield strength is strongly dependent on the length of time at which the strip is at the peak temperature. The resultant product is not intended to be a low stress grade in the thermal flattened condition but is intended for use in transformer cores or other electromagnetic devices which must be subsequently stress relief annealed. The process produces electrical steel suited for this application with excellent flatness and improved magnetic quality after the stress relief anneal from about 1450° to 1700° F. (790° to 925° C.). Preferably the stress relief anneal is from 1500° to 1575° F. (815° to 855° C.).

The lower flattening temperature of the present process also provides greater high temperature strength in the steel. This allows for greater tension in the strip to be used to develop the desired flatness and also provides greater tracking capabilities in the furnace. Since the strip temperatures are lowered with the present invention, the productivity is increased since it takes less time to heat the strip up to temperature. The present invention does not require any special atmosphere control or heating/cooling rates to develop the flattened strip and does not require any lengthy soak at peak temperature. Productivity may be further increased by using rapid heating rates, short soaking times and rapid cooling rates. The 0.2% yield strength of the materials during flattening is increased with the present practice. The change in strength levels for various silicon contents is very minor.

Control of the ratio between the yield strength of the steel during flattening and the flattening tension in the furnace has been found to be an effective means to control the improvements to the core loss after the stress relief anneal. A range of yield strength to flattening tension of above 5 to about 20 and preferably about 7 to 13 has resulted in consistent magnetic quality improvement after the stress relief anneal.

The superior magnetic quality after stress relief annealing appears to be related to the substructure produced by the low temperature—high tension flattening conditions. The present invention also provides improved tension from a secondary coating when the coating is thermally flattened by the present invention. The present invention has developed a process wherein the flattened strip is more amenable to the conditions of the stress relief anneal, has improved magnetic properties after stress relief annealing and produces excellent flatness at higher productivity levels.

DETAILED DESCRIPTION OF THE PREFERRED EMBODIMENT

Figure 1:
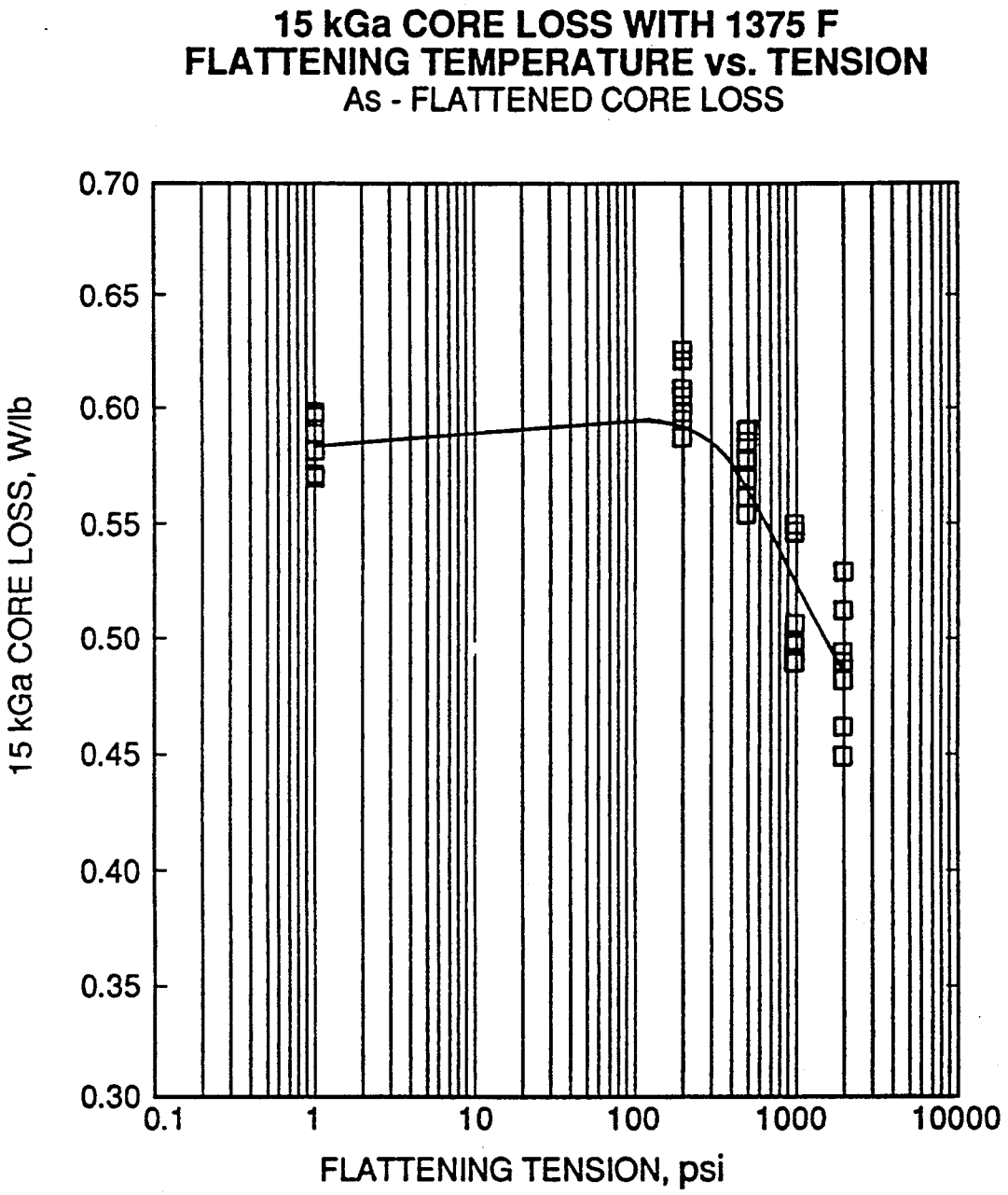
FIG. 1 is a graph showing the influence of tension during thermal flattening at 1375° F. on the core loss at 15 kG in the flattened condition.

Prior to the thermal flattening process of the invention, silicon steel coils of final gage are annealed at very high temperatures to develop the desired grain size and crystal orientation. To prevent the laps from sticking during the final high temperature anneal, an annealing separator coating is used. This coating is normally a magnesium oxide coating which reacts with the silica on the surface of the steel to form forsterite or mill glass. Phosphate coatings may be applied after the final anneal and/or are used to provide a tension effect on the steel and to improve the insulative properties of the steel. Various secondary coatings containing aluminum phosphates, magnesium phosphates or combinations of the two may be used with any of the well known additives such as colloidal silica.

In this specification, the term "space factor" refers to a percentage of the volume of the solid mass in a stacked or wound core as determined by its density compared to the volume of the stack under a specified pressure. Interlamination resistance is the electrical resistance measured in a direction perpendicular to the plane of the stack of laminations.

The semi-processed applications for the magnetic sheet material with which the invention is mainly concerned include wound transformer cores and laminations for stacked cores and other electrical apparatus which are stress relief annealed after fabrication. The stress relief anneal relieves the stresses developed during the mechanical working of the steel during the fabrication operations, which may include winding, slitting, punching or forming.

The base metal of the present invention is (110) or "Gross" oriented electrical steel having a silicon content of at least about 3% and may be either a conventional or high permeability type of grain oriented electrical steel. The carbon has been reduced to a level below 0.01% and normally below 0.004%. The differences in base metal response to the flattening treatment are slight based on differences in composition.

The final anneal will unavoidably produce a coil set which results from coiling the steel. The strip requires a flattening operation. The production of a wound or laminated core will also produce considerable strain which has an adverse influence on the magnetic quality. By subjecting the final annealed strip to a flattening treatment using a temperature of about 1000° to 1435° F. (540° to 780° C.), and preferably about 1175° to 1375° F. (635° to 745° C.), the response to the stress relief anneal will be improved as shown by the final magnetic properties.

The strength will vary considerably depending on the flattening temperature and soak time. To use the ratio of 0.2% yield strength to flattening tension to develop the relationship between above 5 to 15 and preferably 7–13, the line tension in the furnace can easily be calculated. The tension required for flattening is obtained and the relationship is determined to provide the desired substructure and the best tension imparting characteristics from the secondary coating. The following formula may be used to predict the yield strengths based on the flattening conditions:

$$0.2\% \text{ Yield Strength} = 11.6(1/t)^{0.176} \exp[15080.7/RT]$$

0.2% Yield Strength = stress required 0.2% elongation(psi)

t = time at peak temperature in seconds

R = constant, 1.987 cal/mol °K

T = flattening temperature, °K

Figure 5:
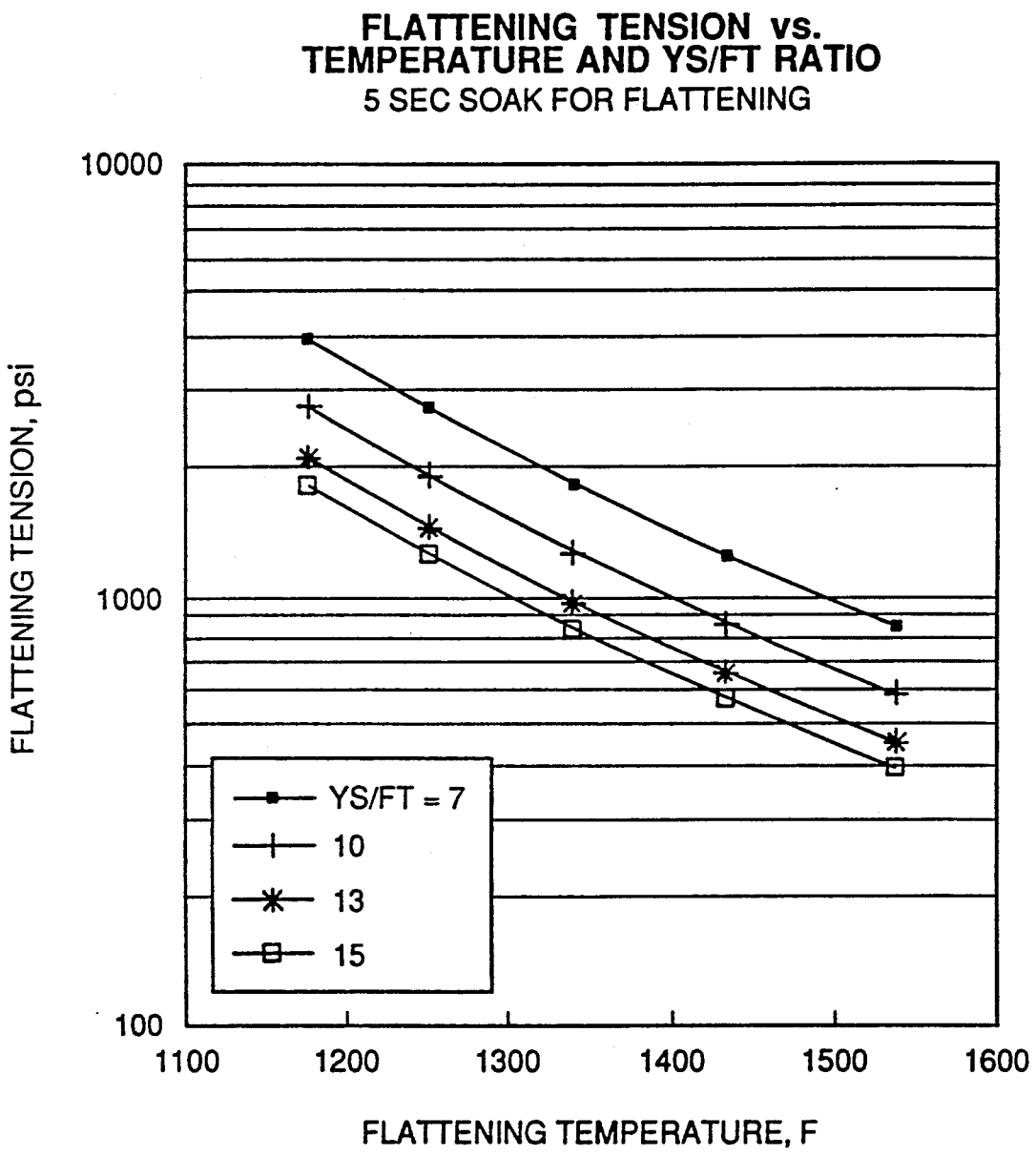
FIG. 5 is a graph using a log scale to illustrate the influence of flattening tension vs. temperature with regards to the 0.2% yield strength to tension ratio.

To illustrate how this relationship may be used to calculate yield strengths, the following calculations are provided for a 30 second soak at peak temperature as shown in FIG. 5;

| Temperature | Yield Strength | Flattening Tension YS/Tension Ratio | | | |
|---|---|---|---|---|---|
| | | 7 | 10 | 13 | 15 |
| 1175° F. | 27203 | 3886 | 2720 | 2093 | 1814 |
| 1250° F. | 18851 | 2693 | 1885 | 1450 | 1257 |
| 1340° F. | 12640 | 1806 | 1264 | 972 | 843 |
| 1435° F. | 8638 | 1234 | 864 | 664 | 576 |
| 1540° F. | 5914 | 845 | 591 | 455 | 394 |

Figure 6:
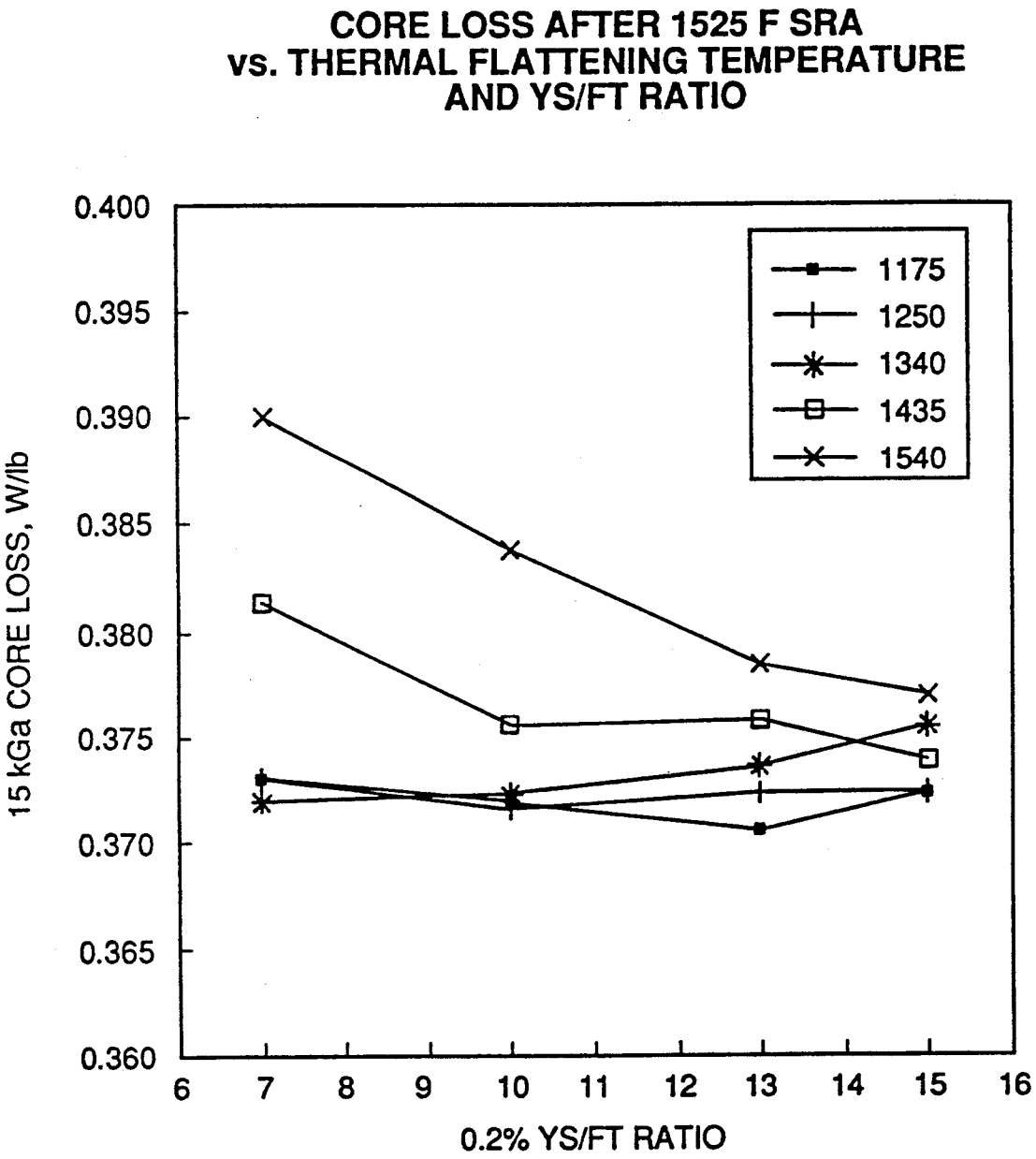
FIG. 6 is a graph showing the influence of the thermal flattening temperature and 0.2% yield strength/flattening tension ratio on the core loss properties after a 1525° F. (830° C.) stress relief anneal.

FIG. 5 shows the various tension levels required for maintaining the desired YS/FT ratios for the range of thermal flattening temperatures. The curves are for a 5 second soak at the flattening temperatures. FIG. 6 shows the importance of the lower thermal flattening temperatures and the relationship of core loss after stress relief annealing for the various ratios of 0.2% yield strength of the material to the flattening tension.

The process of thermally flattening a grain oriented silicon steel product having a glass film or a secondary coating or both has not been fully understood in the past. Furthermore, the change to thinner gages has resulted ina nonuniform product after thermal flattening for wound core applications.

The flattening conditions of the present invention involve a better understanding of the glass film conditions and the ability to produce a product which has improved response to the stress relief annealing process.

The thermal flattening process of the present invention relies on the ability of the glass coated steel to respond to a low temperature-high tension process which develops optimum properties after a stress relief anneal. Thermal flattening is obtained by heating the strip to a temperature of about 1000° to 1435° F. (540° to 780° C.) and preferably about 1175° to 1375° F. (635° to 745° C.). The temperature is effective in combination with a tension of about 400 to 4000 psi (29,200 to 292,000 gm/m$^2$) and preferably about 500 to 1250 psi (about 35,000 to 88,000 gm/cm$^2$) and more preferably about 650 to 950 psi (46,000 to 67,000 gm/cm$^2$). It is this combination of conditions which produces the desired yield strength at temperature to allow the use of high line tension. This permits improved tracking of the strip in the furnace since prior low tension processes were designed to provide low stress at the completion of the thermal flattening process. The glass film produced by low temperature flattening shows a remarkable improvement in quality since the temperatures are greatly reduced. Typically, a soak of less than 30 seconds is all that is required once temperature is reached.

The process of the present invention has greatly reduced the prior handling problems associated with the thinner gage materials and significantly improved the shape of the strip after stress relief anneal. As mentioned previously, the process and material of the present invention is not a low stress product until given the stress relief anneal. The thermally flattened glass coated strip is thus not intended for stacked core laminations which are not stress relief annealed.

The influence of the conditions on the glass film, which may include a secondary coating, have been found to represent a significant improvement to the overall quality. The lowering of the temperature has lowered the level of internal oxidation which is believed to have resulted from a porous glass film caused by the thermal flattening temperatures being selected for flattening and not for glass film quality. To demonstrate the advantages of this low temperature high tension process, several experiments were conducted.

Figure 2:
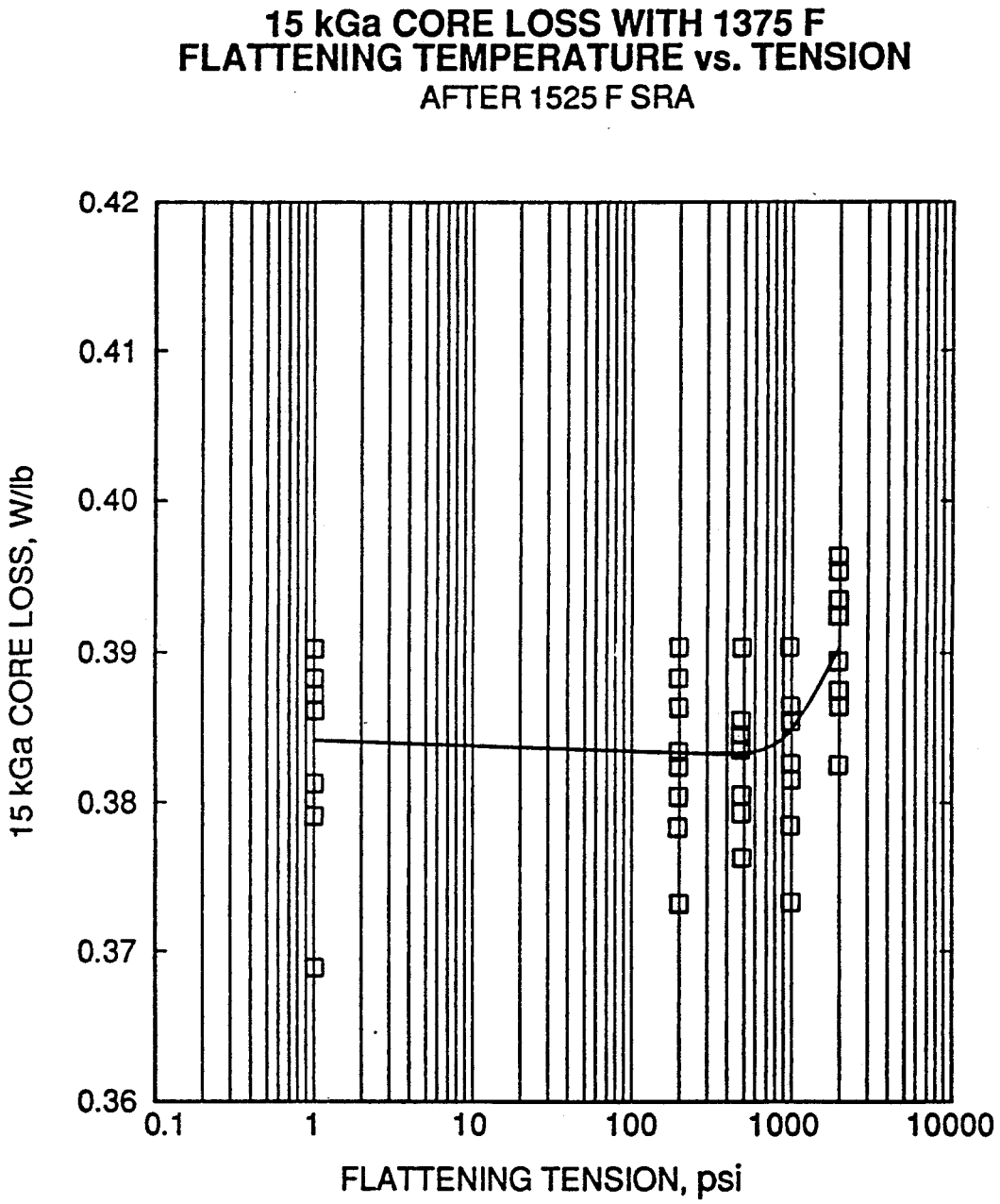
FIG. 2 is a graph showing the effect of flattening tension on core loss after a stress relief anneal at 1525° F. (830° C.) at 15 kG.

The first experiment tested coils of 7-mil (0.18 mm) regular grain oriented silicon steel having a glass film. A continuous anneal at 1375° F. (745° C.) was used with strip tension conditions at 200 psi (14,000 gm/cm$^2$), 500 psi (35,000 gm/cm$^2$), 1,000 psi (70,000 gm/cm$^2$) and 2,000 psi (140,000 gm/cm$^2$) to evaluate the influence of flattening conditions on magnetic properties. The 0.2% yield strength of the steels at this temperature was calculated to be about 7075 psi (about 497,500 gm/cm$^2$). The calculated 0.2% yield strength at 1450° F. (790° C.) was 5275 psi (371,000 gm/cm$^2$) and was used to compare the new thermal flattening conditions with a previous practice. The samples were heated at about 50° F./second (about 30° C./second) in nitrogen and held for about 15 second soak at 1375° F. (745° C.). The samples were sheared into 12 inch (30.5 cm) lengths and tested in the as-flattened condition and in the stress relief annealed condition (1525° F./830° C.; 95%$N_2$—5%$H_2$). The results shown in TABLE 1 clearly indicate the inventive process improves the core loss values after a stress relief anneal on oriented material having a forsterite or "mill glass" coating. Since the levels of tension evaluated did not exceed the yield strength of the material at temperature, there was no change in strip width as would be expected. The results indicate the practice does not produce good core loss as flattened and the material will have a level of stress above about 10%. Increasing the tension obviously improves the flatness but the additional benefit above 1000 psi (70,000 gm/cm$^2$) is marginal. This level of tension appears to be sufficient to remove coil set. At a temperature of 1375° F. (745° C.) and with tensions of about 1000 psi (70,000 gm/cm$^2$), the flattened strip was noted to be easier to handle than as-box annealed material. FIGS. 1 and 2 show the effect of flattening tension on the 15 kG core loss as-flattened and after stress relief annealing at 1525° F. (830° C.).

TABLE 1

MAGNETIC PROPERTIES AFTER THERMAL FLATTENING AT 1375° F. AND AFTER STRESS RELIEF ANNEALING AT 1525° F.

| Flattening | As Flattened at 1375° F. | | | After Stress Relief at Annealing at 1525° F. | | |
|---|---|---|---|---|---|---|
| Tension | H-10 | P15:60 | P17:60 | H-10 | P15:60 | P17:60 |
| (not thermally flattened) | 1803 | 0.586 | 0.777 | 1854 | 0.384 | 0.582 |
| 200 psi | 1839 | 0.606 | 0.794 | 1853 | 0.383 | 0.584 |
| 500 psi | 1841 | 0.573 | 0.765 | 1855 | 0.383 | 0.582 |
| 1000 psi | 1843 | 0.523 | 0.737 | 1852 | 0.383 | 0.585 |
| 2000 psi | 1846 | 0.485 | 0.696 | 1851 | 0.390 | 0.604 |

All samples were forsterite coated only and magnetic data are corrected to 7.2 mils.

A second experiment was conducted using a low temperature-high tension process on oriented silicon steel to evaluate other combinations of conditions. While the quality of the material used in the second experiment was not as good as the first, the benefits from the flattening operation are still demonstrated. The conditions of the experiment are the same as in the first experiment except that the material was from a different oriented steel composition. The results are shown in TABLE 2 and FIGS. 3 and 4. This data seems to indicate a level of 1250 psi (87,500 gm/cm$^2$) would be the upper limit with a temperature of 1375° F. (745° C.) to avoid a deterioration in magnetic properties after stress relief annealing. Apparently the material was overstressed and damaged by excessive tension. However, a tension level below this level with 1375° F. (745° C.) is an improvement to the magnetic properties after stress relief annealing.

TABLE II

EFFECT OF FLATTENING TENSION AT 1375° F. ON MAGNETIC QUALITY OF 7-MIL RGO

| Thermal Flattening Conditions | | As-Sheared or As-Flattened | | | Stress Relief Annealed at 1525° F. | | |
|---|---|---|---|---|---|---|---|
| Temp | Tension | H-10 | P15:60 | P17:60 | H-10 | P15:60 | P17:60 |
| | control | 1823 | 0.545 | 0.741 | 1841 | 0.391 | 0.596 |
| | 750 psi | 1831 | 0.527 | 0.725 | 1842 | 0.390 | 0.597 |
| | 1000 psi | 1835 | 0.475 | 0.687 | 1840 | 0.389 | 0.596 |
| | 1250 psi | 1830 | 0.500 | 0.710 | 1837 | 0.399 | 0.613 |
| | 1500 psi | 1830 | 0.530 | 0.744 | 1836 | 0.421 | 0.641 |
| | 2000 psi | 1831 | 0.485 | 0.703 | 1839 | 0.421 | 0.648 |

Figure 3:
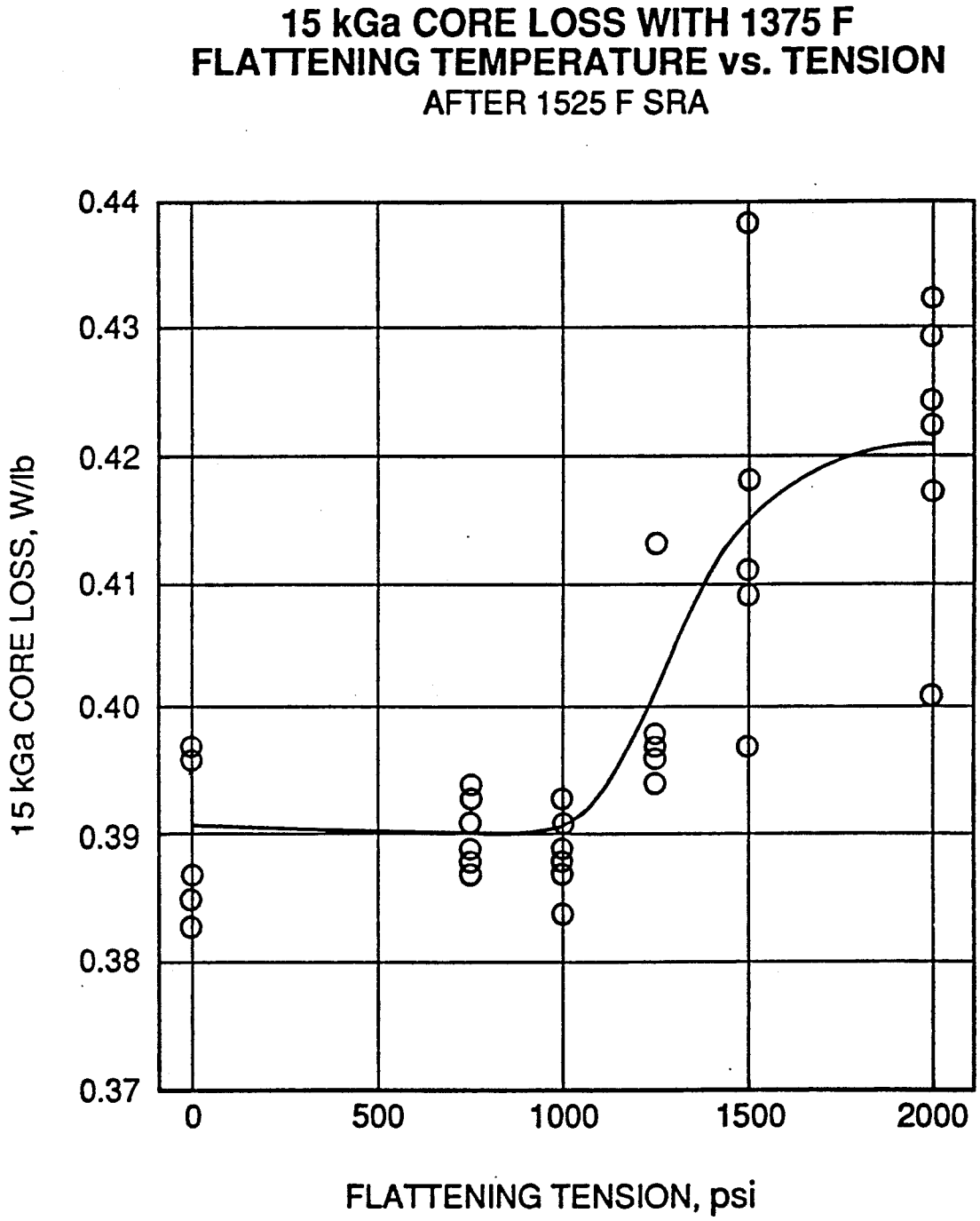
FIG. 3 is a graph showing the effect of flattening tension using a 1375° F. thermal flattening temperature on the core loss at 15 kG after a 1525° F. stress relief anneal.
Figure 4:
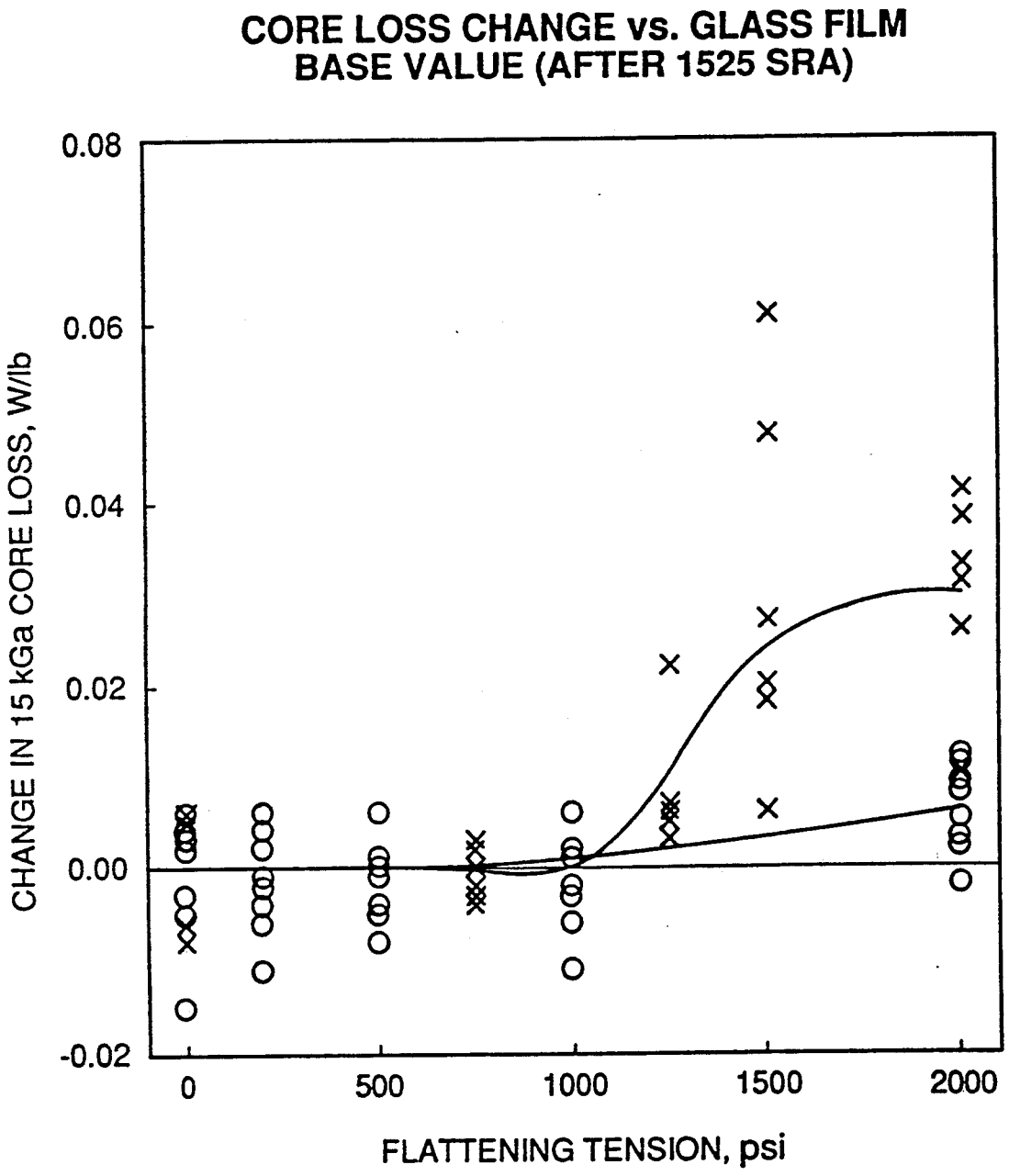
FIG. 4 is a graph showing the change in 15 kG core loss for 2 glass film materials thermally flattened at different tension levels at 1375° F. before and after stress relief annealing at 1525° F. (830° C.).

FIGS. 1 and 2 show the effect of the tension level on the core loss and exciting power after flattening at 15 kG and 17 kG. The core loss values are not improved until the material is given a stress relief anneal. The flatness was shown to improve with increasing tension up to a level of about 1000 psi (70,000 gm/cm$^2$), and above this level there was little improvement. FIGS. 3 and 4 show the true benefits of the present invention. It is after the stress relief anneal that magnetic quality is improved and the stress substantially eliminated.

The quality of the glass film is substantially improved by flattening the strip at a lower temperature and avoiding the damage caused by conventional flattening. The present invention also reduces the coil set from previous conditions which improves the core winding conditions and improves the yield during winding. The quality of the glass coated steel may be further improved by including a thin tension imparting secondary coating on the glass surface. The coating is less than 10 gms/m$^2$ and preferably about 3-6 gms/m$^2$.

The effect of secondary coating weight on the magnetic properties was evaluated using the thermal flattening process of the invention at 1375° F. (745° C.). The results shown in TABLE 3 indicate that further benefits in magnetic properties are obtainable when a thinner coating thickness, such as 3 gms/m$^2$ is used with low temperature flattening.

TABLE III

EFFECT OF THERMAL FLATTENING ON MAGNETIC QUALITY OF 7-MIL RGO HAVING A SECONDARY COATING

| Secondary Coating Weight | As-Box Annealed Strip | | | | | |
|---|---|---|---|---|---|---|
| | As-Sheared | | | Stress Relief Annealed at 1525° F. | | |
| (gms/m$^2$) | H-10 | P15:60 | P17:60 | H-10 | P15:60 | P17:60 |
| 0 Avg. | 1823 | 0.545 | 0.741 | 1841 | 0.391 | 0.596 |
| 3 Avg. | 1815 | 0.551 | 0.752 | 1835 | 0.387 | 0.581 |
| 6 Avg. | 1814 | 0.538 | 0.740 | 1834 | 0.389 | 0.582 |
| 9 Avg. | 1811 | 0.534 | 0.737 | 1831 | 0.391 | 0.586 |
| Secondary Coating Weight | Thermal Flattened at 1375° F. 1000 psi | | | | | |
| | As-Flattened | | | Stress Relief Annealed at 1525° F. | | |
| (gms/m$^2$) | H-10 | P15:60 | P17:60 | H-10 | P15:60 | P17:60 |
| 0 Avg. | 1835 | 0.475 | 0.687 | 1840 | 0.389 | 0.596 |

TABLE III-continued

EFFECT OF THERMAL FLATTENING ON MAGNETIC QUALITY OF 7-MIL RGO HAVING A SECONDARY COATING

| | | | | | | |
|---|---|---|---|---|---|---|
| 3 Avg. | 1833 | 0.423 | 0.626 | 1838 | 0.388 | 0.581 |
| 6 Avg. | 1829 | 0.422 | 0.630 | 1833 | 0.391 | 0.586 |
| 9 Avg. | 1828 | 0.421 | 0.623 | 1832 | 0.389 | 0.585 |
| Secondary | Thermal Flattened at 1575° F. 600 psi | | | | | |
| Coating Weight | As-Flattened | | | Stress Relief Annealed at 1525° F. | | |
| (gms/m²) | H-10 | P15:60 | P17:60 | H-10 | P15:60 | P17:60 |
| 0 Avg. | 1839 | 0.433 | 0.651 | 1839 | 0.398 | 0.612 |
| 3 Avg. | 1837 | 0.410 | 0.608 | 1837 | 0.393 | 0.594 |
| 6 Avg. | 1835 | 0.395 | 0.588 | 1835 | 0.392 | 0.590 |
| 9 Avg. | 1833 | 0.396 | 0.585 | 1833 | 0.392 | 0.587 |

Figure 7:
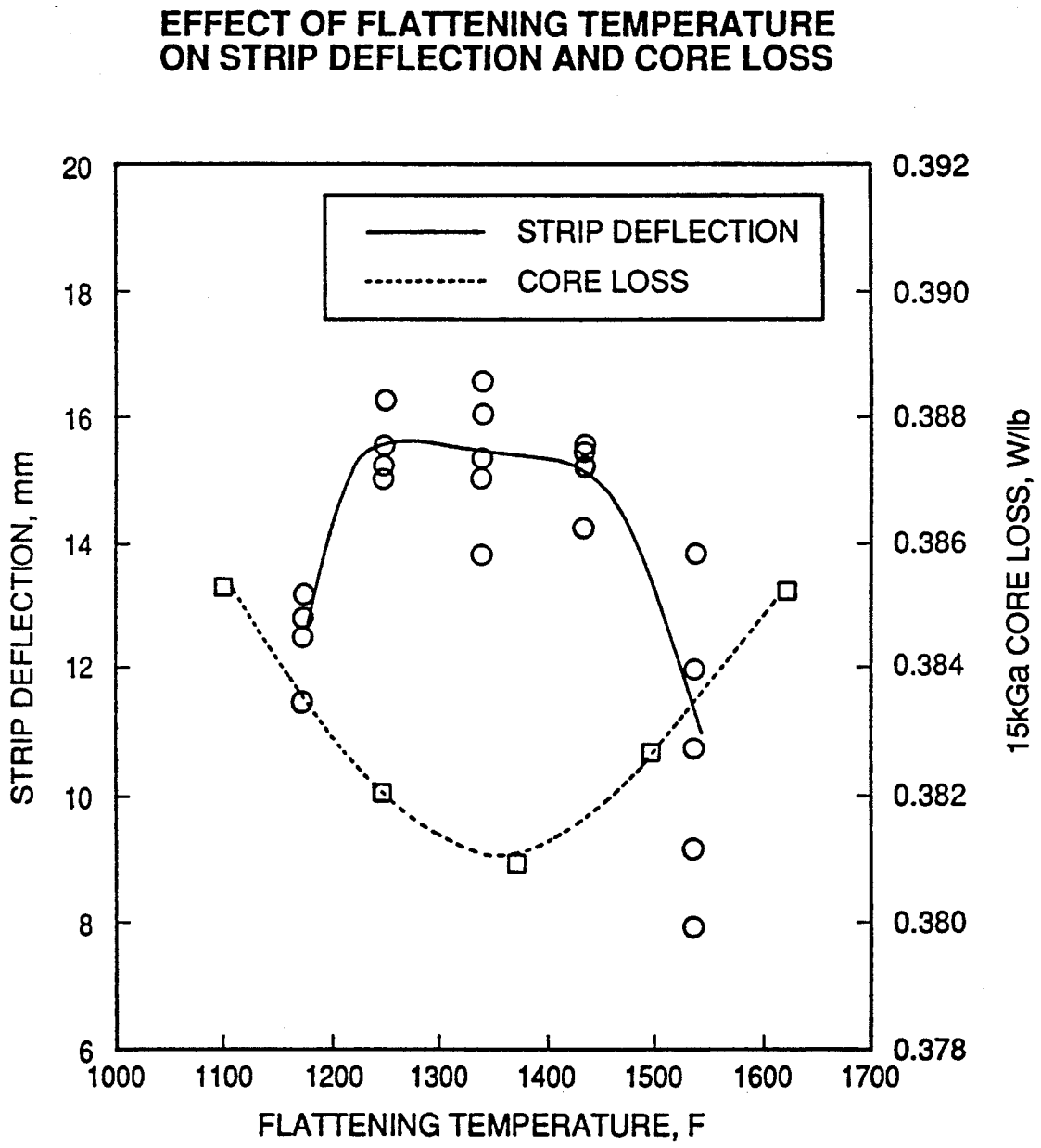
FIG. 7 is a graph showing the influence of the flattening temperature on strip deflection (tension influence) and core loss at 15 kG.

FIG. 7 shows the effect of flattening temperature on the amount of tension imparted to the strip by the coating after stress relief annealing at 1525° F. (830° C.), as measured by the amount of deflection of the strip when the coating is removed from one side. The deflection was measured by hanging 20 cm samples with coating on one side and measuring the horizontal deflection of the end of the sample caused by curvature. The curvature is caused by tension imparted by the coating, so that greater deflections indicate higher levels of tension. FIG. 7 also shows the effect of flattening temperature on 15 kG core loss after a stress relief anneal. Samples with a forsterite or glass film coating were flattened in a batch type stress anneal at 1525° F. (830° C.), a secondary coating was applied and cured at various temperatures, and then the secondary coated samples were stress relief annealed at 1525° F. (830° C.). The final core is influenced by the deterioration in tension imparting characteristics of the secondary coating during the stress relief anneal. The lowest core loss was obtained by flattening from 1250° to 1435° F. (675° to 780° C.), which indicates that the tension imparted by the coating was highest for this temperature range.

The present invention has been described in terms of the preferred embodiments and further limitations should be added except as defined by the following claims:

We claim:

1. A process for thermal flattening semi-processed grain oriented silicon steel having a coating selected from the group consisting of a glass film, a secondary coating and a secondary coating over a glass film, said process being conducted after a final anneal and comprising the steps of:
   a) heating said steel to a temperature of about 1000° to about 1435° F. (540° to about 780° C.);
   b) providing a tension sufficient to provide a 0.2% yield strength/tension ratio of above 5 to about 20;
   c) cooling said steel;
   d) fabricating a steel core article; and
   e) providing a stress relief anneal above about 1450° F. (785° C.) whereby said steel core article has improved core loss.

2. The process of claim 1 wherein said yield strength to tension ratio during thermal flattening is 7 to 13.

3. The process of claim 1 wherein said thermal flattening temperature is 1175° to 1375° F. (635° to 745° C.).

4. The process of claim 1 wherein said stress relief anneal is from 1525° to 1575° F. (830° to 860° C.).

5. The process of claim 1 wherein said coating includes a secondary coating having a phosphate base composition which is applied in an amount up to 10 gms/m².

6. A process for preparing semi-processed grain oriented electrical steel for core production wherein a stress relief anneal above 1450° F. (785° C.) is provided after said core is produced, said process comprising the steps of:
   a) providing an annealing separator coating on said steel;
   b) subjecting said coated steel to a final high temperature anneal;
   c) thermal flattening said annealed steel at a temperature from about 1000° to 1435° F. (about 540° to 780° C.) with a tension sufficient to provide a 0.2% yield strength/tension ratio from above 5 to about 20 whereby a level of stress above about 10% is produced to improve core production and provide improved magnetic properties after said stress relief anneal.

7. The method of claim 6 wherein said strip is from 6 to 9 mils (0.23 to 0.15 mm) in thickness.

8. The method of claim 6 wherein said strip has a forsterite film and a secondary coating applied prior to said flattening treatment.

9. The method of claim 6 wherein said secondary coating is phosphate based and includes at least one metal selected from the group consisting of aluminum and magnesium.

10. The method of claim 6 wherein said yield strength to tension ratio is from 7 to 13.

11. The method of claim 6 wherein said flattening temperature is from 1175° to 1375° F. (635° to 745° C.).

12. The method of claim 1 wherein said yield strength is controlled by adjusting the soak time at peak temperature during the flattening operation.

13. The method of claim 6 wherein said yield strength is controlled by adjusting the soak time at peak temperature during the flattening operation.

14. A method for improving the magnetic properties of semi-processed grain oriented silicon steel which has been given a final high temperature anneal, said steel having a coating selected from the group consisting of a glass film, a secondary coating and a secondary coating over a glass film, said method comprising the steps of:
   a) heating said final annealed steel to a flattening temperature of about 1000° F. to about 1435° F. (about 540° C. to about 780° C.);
   b) providing a tension of about 400 psi to about 4000 psi (about 29,200 to about 292,000 gms/cm²) at said flattening temperature to provide a level of stress below the 0.2% yield strength for said steel at said flattening temperature;
   c) producing a core; and
   d) providing a stress relief anneal above about 1450° F. (about 785° C.) whereby said steel has improved core loss in the stress relief annealed condition.

15. The method of claim 14 wherein said tension is about 500 psi to about 2500 psi (about 36,500 to about 182,500 gms/cm²) at said flattening temperature.

16. The method of claim 14 wherein said yield strength is controlled by adjusting soak time at peak temperature during the flattening operation.

* * * * *